US011892239B2

(12) United States Patent
Machida

(10) Patent No.: US 11,892,239 B2
(45) Date of Patent: Feb. 6, 2024

(54) LOOP-TYPE HEAT PIPE INCLUDING AN EVAPORATOR, FIRST AND SECOND CONDENSERS, A LIQUID PIPE CONNECTING THE EVAPORATOR TO THE FIRST AND SECOND CONDENSERS, AND FIRST AND SECOND VAPOR PIPES CONNECTING THE EVAPORATOR TO THE FIRST AND SECOND CONDENSERS

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 40 days.

(21) Appl. No.: 17/243,927

(22) Filed: Apr. 29, 2021

(65) Prior Publication Data

US 2021/0356210 A1 Nov. 18, 2021

(30) Foreign Application Priority Data

May 12, 2020 (JP) ..... 2020-083973

(51) Int. Cl.
*F28D 15/02* (2006.01)

(52) U.S. Cl.
CPC ..... *F28D 15/0266* (2013.01)

(58) Field of Classification Search
CPC ..... F28D 15/0266; F28D 15/043; F28D 15/0275; F28D 15/046; F28D 15/04
See application file for complete search history.

(56) References Cited

U.S. PATENT DOCUMENTS 5,924,481 A * 7/1999 Tajima ..... F28D 15/0275 174/15.2
5,998,863 A * 12/1999 Kobayashi ..... F28F 3/12 361/699
6,058,711 A 5/2000 Maciaszek et al.
(Continued)

FOREIGN PATENT DOCUMENTS

CN 108267037 7/2018
CN 108267037 A * 7/2018 ..... F28D 15/043
(Continued)

OTHER PUBLICATIONS

European Search Report dated Oct. 6, 2021, 7 pages.
(Continued)

*Primary Examiner* — Tho V Duong
(74) *Attorney, Agent, or Firm* — Rankin, Hill & Clark LLP

(57) ABSTRACT

A loop-type heat pipe includes an evaporator configured to vaporize an operating fluid, a first condenser and a second condenser configured to condense the operating fluid, a liquid pipe configured to connect the evaporator and the first condenser and second condenser, a first vapor pipe configured to connect the evaporator and the first condenser; and a second vapor pipe configured to connect the evaporator and the second condenser. The liquid pipe includes a first liquid pipe having a first flow path and connected to the first condenser, a second liquid pipe having a second flow path and connected to the second condenser, and a third liquid pipe having a third flow path connecting to the first flow path and the second flow path and connected to the evaporator.

7 Claims, 10 Drawing Sheets

(56) References Cited

U.S. PATENT DOCUMENTS

| | | | | |
|---|---|---|---|---|
| 7,380,585 | B2 | 6/2008 | Liu et al. | |
| 8,705,236 | B2 | 4/2014 | Uchida et al. | |
| 2004/0188568 | A1* | 9/2004 | Gayrard | B64G 1/641 244/171.8 |
| 2008/0164010 | A1 | 7/2008 | Kang et al. | |
| 2008/0308257 | A1 | 12/2008 | Peng et al. | |
| 2012/0186787 | A1* | 7/2012 | Dinh | F28D 15/06 165/104.26 |
| 2017/0029126 | A1* | 2/2017 | Sarno | B33Y 10/00 |
| 2018/0058767 | A1 | 3/2018 | Machida et al. | |
| 2018/0134124 | A1* | 5/2018 | Kozasa | F28D 15/0266 |
| 2018/0142960 | A1* | 5/2018 | Kurashima | F28F 3/08 |
| 2018/0164043 | A1* | 6/2018 | Kurashima | F28D 15/046 |
| 2019/0090385 | A1* | 3/2019 | Machida | F28F 3/086 |
| 2019/0128620 | A1* | 5/2019 | Machida | F28D 15/043 |
| 2019/0242652 | A1 | 8/2019 | Machida | |
| 2020/0096261 | A1 | 3/2020 | Tanaka et al. | |

FOREIGN PATENT DOCUMENTS

| | | | |
|---|---|---|---|
| JP | 2008-021697 | A | 1/2008 |
| JP | 6291000 | | 2/2018 |
| JP | 6400240 | | 9/2018 |
| JP | 2020-051638 | A | 4/2020 |

OTHER PUBLICATIONS

Japanese Office Action from Corresponding Japanese Application No. 2020-083973, dated Aug. 22, 2023 with English translation, 10 pages.

* cited by examiner

LOOP-TYPE HEAT PIPE INCLUDING AN EVAPORATOR, FIRST AND SECOND CONDENSERS, A LIQUID PIPE CONNECTING THE EVAPORATOR TO THE FIRST AND SECOND CONDENSERS, AND FIRST AND SECOND VAPOR PIPES CONNECTING THE EVAPORATOR TO THE FIRST AND SECOND CONDENSERS

CROSS-REFERENCE TO RELATED APPLICATIONS

This application is based upon and claims the benefit of priority from prior Japanese patent application No. 2020-083973, filed on May 12, 2020, the entire contents of which are incorporated herein by reference.

TECHNICAL FIELD

The present disclosure relates to a loop-type heat pipe.

BACKGROUND ART

In the related art, a heat pipe is known as a device configured to cool a heat generation component such as a CPU (Central Processing Unit) mounted on an electronic device. The heat pipe is a device configured to transport heat by using a phase change of an operating fluid.

As the heat pipe, a loop-type heat pipe including an evaporator configured to vaporize an operating fluid by heat of a heat generation component and a condenser configured to condense the vaporized operating fluid where the evaporator and the condenser are connected to each other by a liquid pipe and a vapor pipe forming a loop-shaped flow path may be exemplified. In the loop-type heat pipe, the operating fluid flows in one direction in the loop-shaped flow path.

The evaporator and the liquid pipe of the loop-type heat pipe are each provided therein with a porous body, so that the operating fluid in the liquid pipe is guided to the evaporator with a capillary force generated in the porous bodies and the vapor is suppressed from flowing from the evaporator back to the liquid pipe. The porous body is formed with a plurality of pores. Each of the pores is formed as a bottomed hole formed on one surface-side of a metal layer and a bottomed hole formed on the other surface-side partially communicate with each other (for example, refer to PTLs 1 and 2).

CITATION LIST

Patent Document

[PTL 1] Japanese Patent No. 6,291,000
[PTL 2] Japanese Patent No. 6,400,240

In recent years, an amount of heat generation in a heat generation component increases as a signal processing speed is improved, so that it may be difficult to sufficiently radiate heat in the loop-type heat pipe of the related art.

SUMMARY OF INVENTION

Aspect of non-limiting embodiments of the present disclosure is to provide a loop-type heat pipe capable of radiating more heat to an outside.

A loop-type heat pipe according to the non-limiting embodiment of the present disclosure comprises:

an evaporator configured to vaporize an operating fluid;

a first condenser and a second condenser configured to condense the operating fluid;

a liquid pipe configured to connect the evaporator and the first condenser and second condenser;

a first vapor pipe configured to connect the evaporator and the first condenser; and a second vapor pipe configured to connect the evaporator and the second condenser, wherein the liquid pipe comprises:

a first liquid pipe having a first flow path and connected to the first condenser, a second liquid pipe having a second flow path and connected to the second condenser, and a third liquid pipe having a third flow path connecting to the first flow path and the second flow path and connected to the evaporator.

According to the present disclosure, it is possible to radiate more heat to the outside.

DESCRIPTION OF EMBODIMENTS

Hereinbelow, embodiments will be described with reference to the drawings. Note that, in the respective drawings, the same constitutional parts are denoted with the same reference signs, and the overlapping descriptions may be omitted.

First Embodiment

[Structure of Loop-Type Heat Pipe of First Embodiment]

Figure 1:
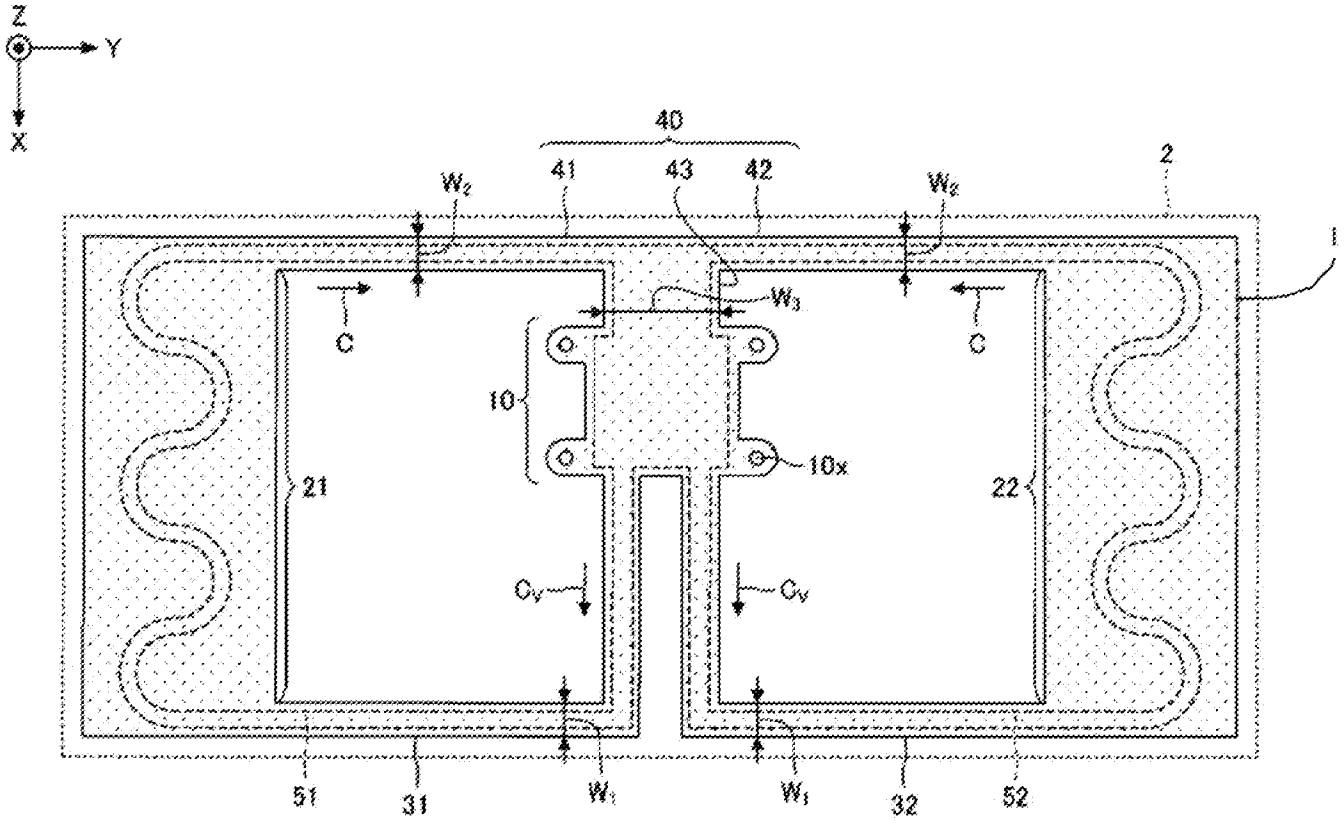
FIG. 1 is a schematic plan view depicting a loop-type heat pipe in accordance with a first embodiment.

First, a structure of a loop-type heat pipe in accordance with a first embodiment is described. FIG. 1 is a schematic plan view exemplifying the loop-type heat pipe in accordance with the first embodiment.

Referring to FIG. 1, a loop-type heat pipe 1 includes an evaporator 10, a first condenser 21, a second condenser 22, a first vapor pipe 31, a second vapor pipe 32, and a liquid pipe 40. The liquid pipe 40 includes a first liquid pipe 41, a second liquid pipe 42, and a third liquid pipe 43. The loop-type heat pipe 1 can be accommodated in a mobile-type electronic device 2 such as a smart phone and a tablet terminal, for example.

In the loop-type heat pipe 1, the evaporator 10 has a function of vaporizing an operating fluid C to generate vapor Cv. The first condenser 21 and the second condenser 22 each have a function of condensing the vapor Cv of the operating fluid C. The first liquid pipe 41 is connected to the first condenser 21, the second liquid pipe 42 is connected to the second condenser 22, and the third liquid pipe 43 is connected to the evaporator 10. The evaporator 10 and the first condenser 21 are connected to each other by the first vapor pipe 31, the first liquid pipe 41 and the third liquid pipe 43. The evaporator 10 and the second condenser 22 are connected to each other by the second vapor pipe 32, the second liquid pipe 42 and the third liquid pipe 43.

Figure 2:
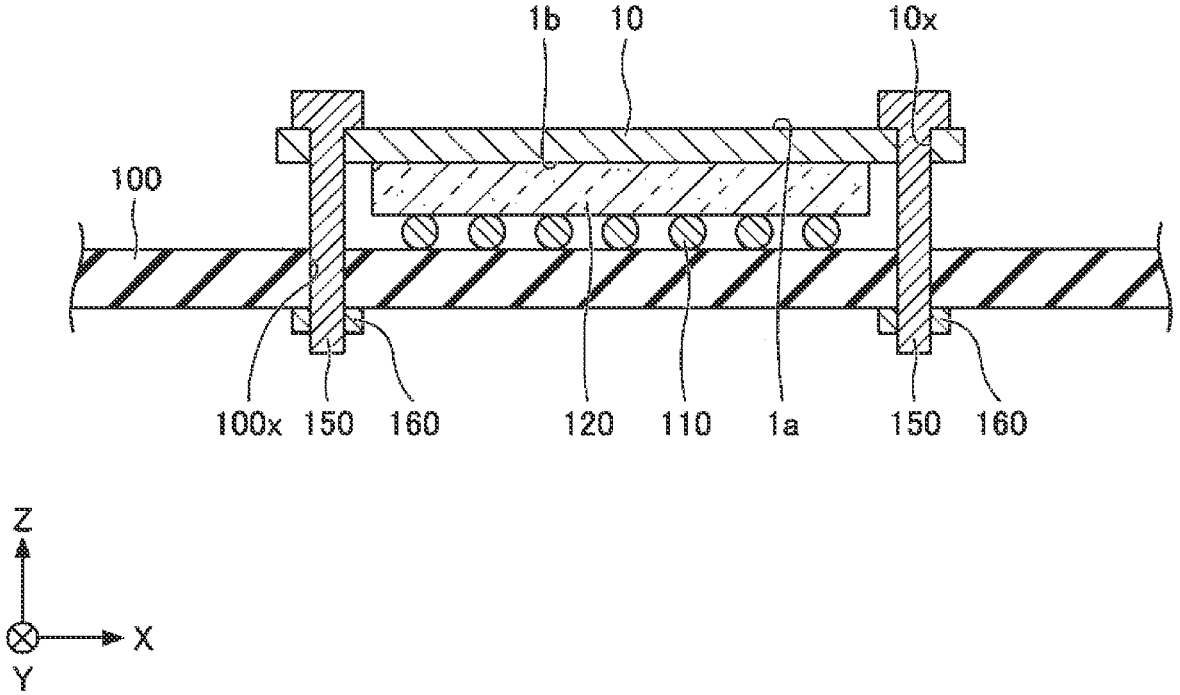
FIG. 2 is a sectional view depicting an evaporator and a surrounding thereof of the loop-type heat pipe in accordance with the first embodiment.

FIG. 2 is a sectional view depicting an evaporator and a surrounding thereof of the loop-type heat pipe in accordance with the first embodiment. As shown in FIGS. 1 and 2, the evaporator 10 is formed with, for example, four through-holes 10*x*. Bolts 150 are each inserted in each of the through-holes 10*x* formed in the evaporator 10 and each of through-holes 100*x* formed in a circuit substrate 100, and are fastened with nuts 160 from a lower surface-side of the circuit substrate 100, so that the evaporator 10 and the circuit substrate 100 are fixed to each other. The evaporator 10, the first condenser 21, the second condenser 22, the first vapor pipe 31, the second vapor pipe 32, the first liquid pipe 41, the second liquid pipe 42 and the third liquid pipe 43 have an upper surface 1*a* and a lower surface 1*b* opposite to the upper surface 1*a*.

A heat generation component 120 such as a CPU is mounted on the circuit substrate 100 by bumps 110, and an upper surface of the heat generation component 120 is closely contacted to the lower surface 1*b* of the evaporator 10. The operating fluid C in the evaporator 10 is vaporized by heat generated in the heat generation component 120, so that the vapor Cv is generated.

As shown in FIG. 1, the vapor Cv generated in the evaporator 10 is guided to the first condenser 21 through the first vapor pipe 31 and is condensed in the first condenser 21, and is also guided to the second condenser 22 through the second vapor pipe 32 and is condensed in the second condenser 22. Thereby, heat generated in the heat generation component 120 is moved to the first condenser 21 and the second condenser 22, so that temperature rise in the heat generation component 120 is suppressed. The operating fluid C condensed in the first condenser 21 is guided to the evaporator 10 through the first liquid pipe 41 and the third liquid pipe 43. The operating fluid C condensed in the second condenser 22 is guided to the evaporator 10 through the second liquid pipe 42 and the third liquid pipe 43. A width $W_1$ of each of the first vapor pipe 31 and the second vapor pipe 32 may be set to about 8 mm, for example. A width $W_2$ of each of the first liquid pipe 41 and the second liquid pipe 42 may be set to about 6 mm, for example. A width $W_3$ of the third liquid pipe 43 may be set to about 20 mm, for example.

A type of the operating fluid C is not particularly limited. However, a fluid having a high vapor pressure and a high evaporative latent heat is preferably used so as to effectively cool the heat generation component 120 by the evaporative latent heat. Examples of such a fluid may include ammonia, water, Freon, alcohol and acetone.

The evaporator 10, the first condenser 21, the second condenser 22, the first vapor pipe 31, the second vapor pipe 32, the first liquid pipe 41, the second liquid pipe 42 and the third liquid pipe 43 may each have a structure where a plurality of metal layers is stacked, for example. As described later, the evaporator 10, the first condenser 21, the second condenser 22, the first vapor pipe 31, the second vapor pipe 32, the first liquid pipe 41, the second liquid pipe 42 and the third liquid pipe 43 each have a structure where six layers of metal layers 61 to 66 are stacked (refer to FIGS. 4A to 5).

The metal layers 61 to 66 are copper layers having high heat conductivity, for example, and are directly bonded to each other by solid-phase bonding and the like. A thickness of each of the metal layers 61 to 66 may be set to about 50 μm to 200 μm, for example. Note that, the metal layers 61 to 66 are not limited to the copper layers and may be formed of stainless steel, aluminum, magnesium alloy and the like. The number of the stacked metal layers is not particularly limited. For example, five or less metal layers or seven or more metal layers may be stacked.

As used herein, the solid-phase bonding is a method of heating and softening bonding targets in a solid state without melting the same, and then further pressing, plastically deforming and bonding the bonding targets. All materials of the metal layers 61 to 66 are preferably the same so that the metal layers adjacent to each other can be favorably bonded by the solid-phase bonding.

Figure 4A:
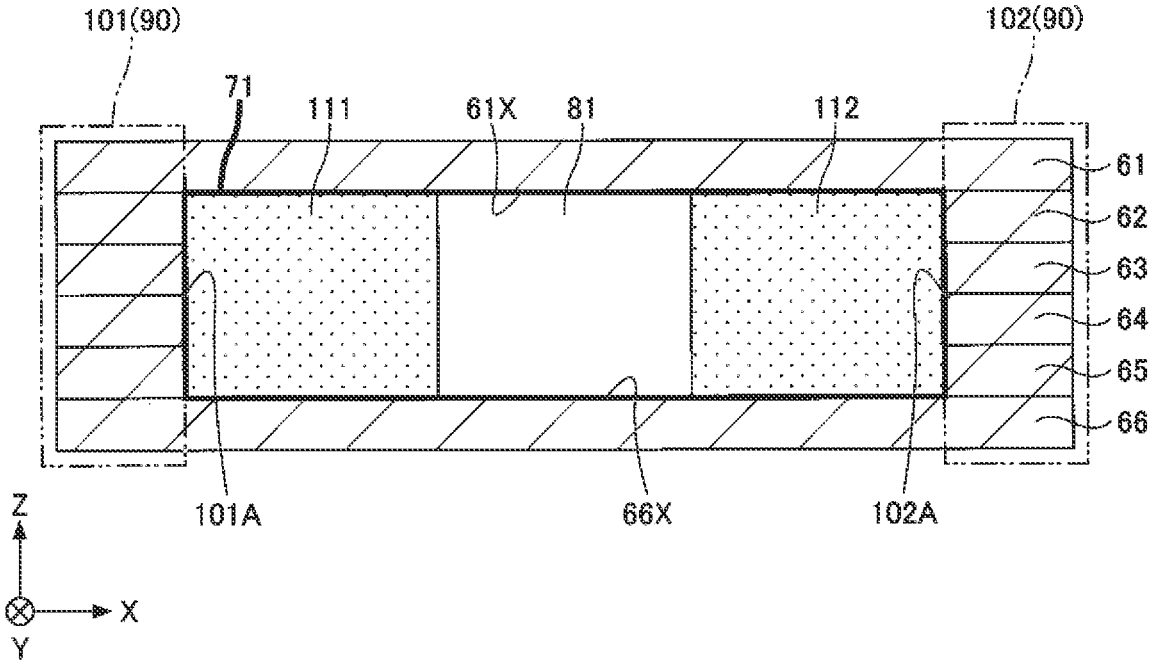
FIG. 4A is a sectional view taken along the line IVa-IVa in FIG. 3, exemplifying the liquid pipe of the loop-type heat pipe in accordance with the first embodiment.
Figure 4B:
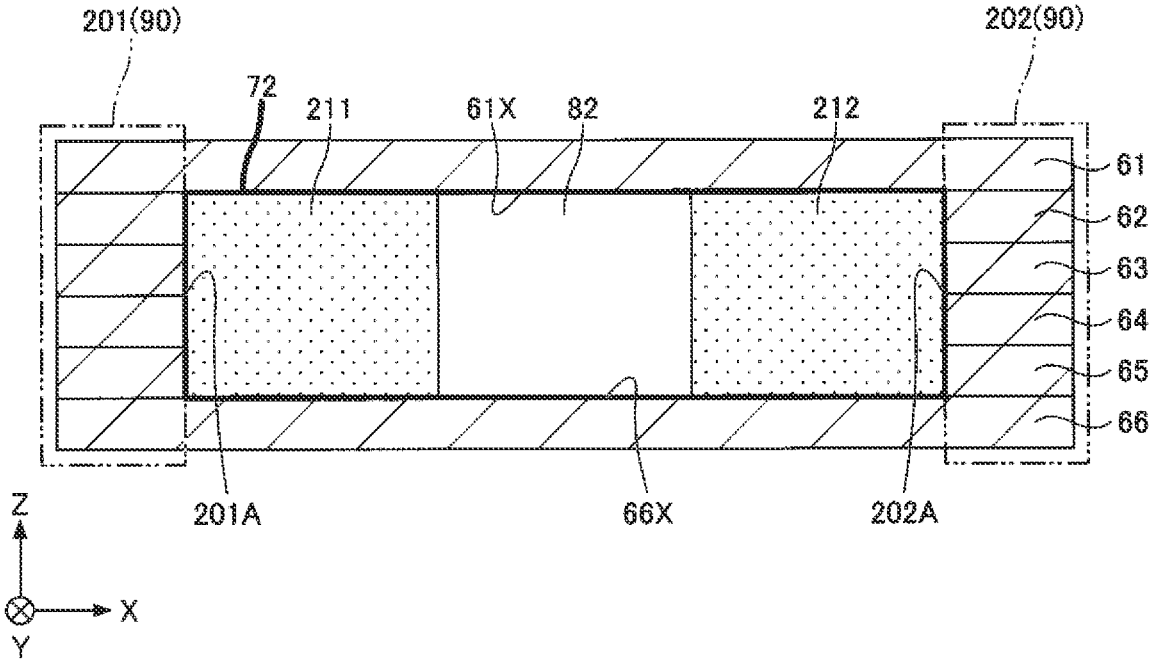
FIG. 4B is a sectional view taken along the line IVb-IVb in FIG. 3, exemplifying the liquid pipe of the loop-type heat pipe in accordance with the first embodiment.
Figure 5:
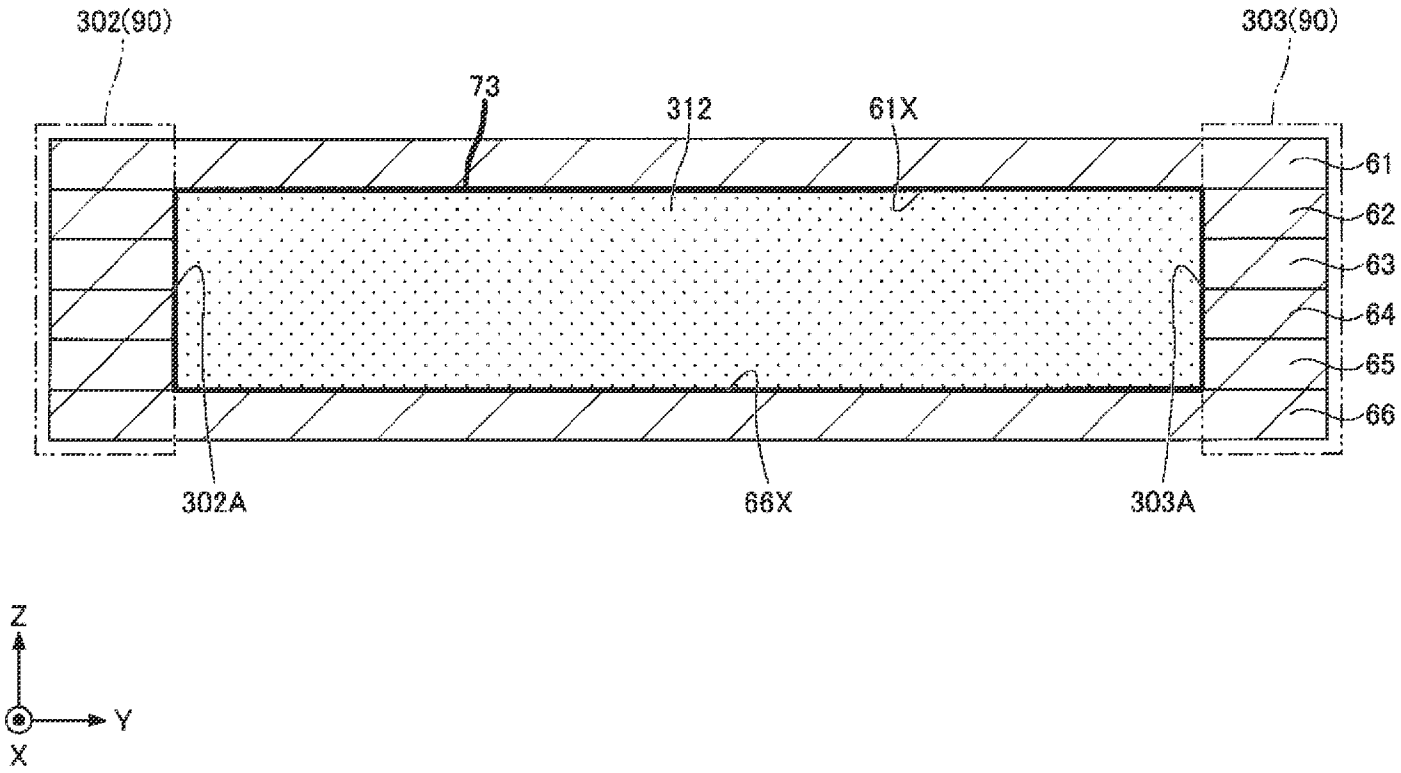
FIG. 5 is a sectional view exemplifying the liquid pipe of the loop-type heat pipe in accordance with the first embodiment.

As shown in FIGS. 4A to 5, the evaporator 10, the first condenser 21, the second condenser 22, the first vapor pipe 31, the second vapor pipe 32, the first liquid pipe 41, the second liquid pipe 42 and the third liquid pipe 43 each have pipe walls 90, each of which is constituted by all the stacked metal layers 61 to 66, at both end portions in a direction orthogonal to both a flowing direction of the operating fluid C or the vapor Cv and a stacking direction of the metal layers 61 to 66.

As shown in FIG. 1, the evaporator 10, the first vapor pipe 31, the first condenser 21, the first liquid pipe 41 and the third liquid pipe 43 are formed with a loop-shaped flow path 51. The evaporator 10, the second vapor pipe 32, the second condenser 22, the second liquid pipe 42 and the third liquid pipe 43 are formed with a loop-shaped flow path 52. For example, the flow paths 51 and 52 are all surrounded by both inner wall surfaces of the two pipe walls 90, a lower surface of the metal layer 61 and an upper surface of the metal layer 66. The operating fluid C or the vapor Cv flows in the flow paths 51 and 52. As described later, parts of the flow paths 51 and 52 are provided with porous bodies, and a remaining part of the flow paths 51 and 52 is a space.

Figure 3:
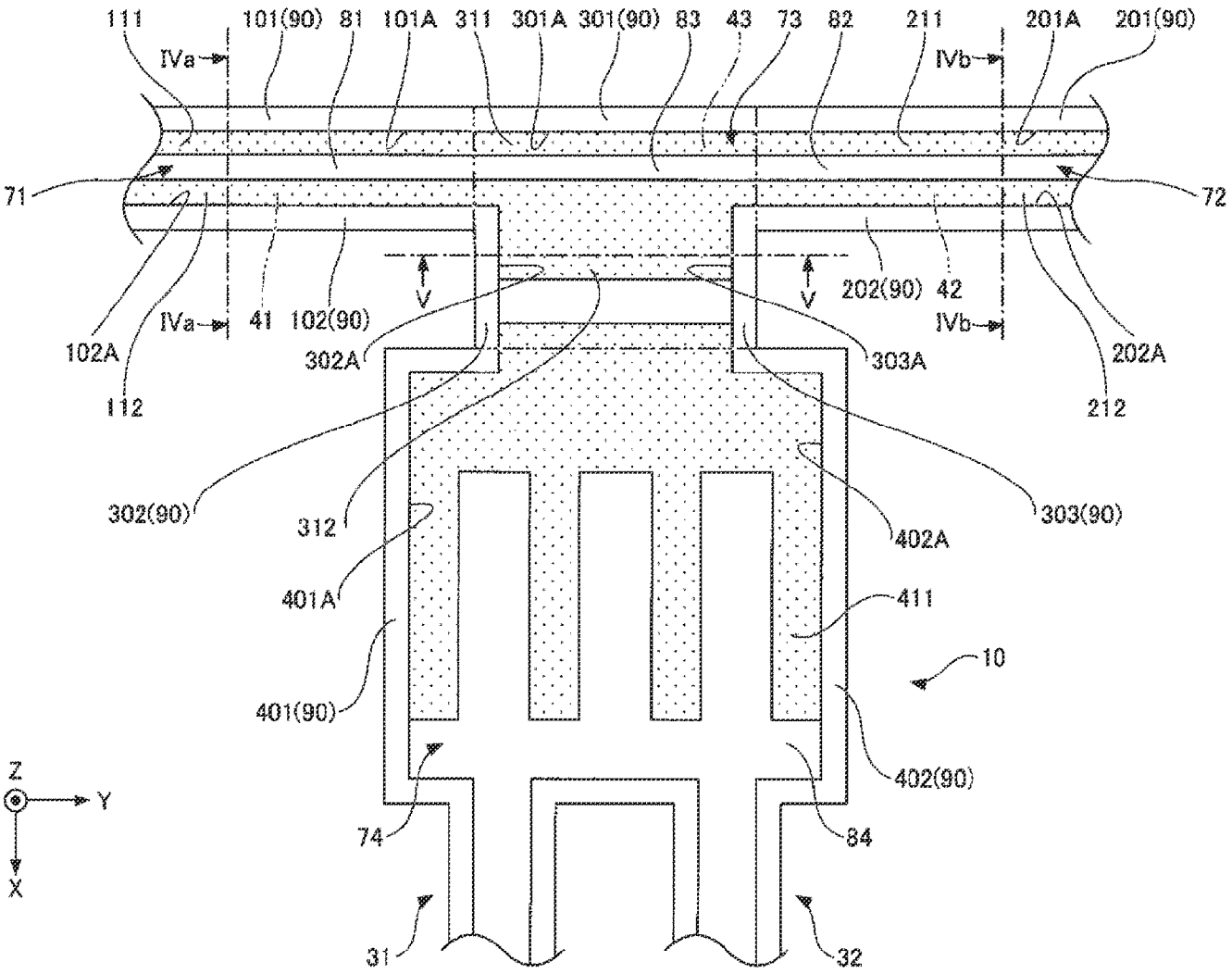
FIG. 3 is a schematic plan view depicting the evaporator and a liquid pipe of the loop-type heat pipe in accordance with the first embodiment.

Here, structures of the evaporator 10 and the liquid pipe 40 are described. FIG. 3 is a schematic plan view depicting the evaporator 10 and the liquid pipe 40 of the loop-type heat pipe in accordance with the first embodiment. FIGS. 4A to 5 are sectional views exemplifying the liquid pipe 40 of the loop-type heat pipe in accordance with the first embodiment. In FIG. 3, a metal layer (the metal layer 61 shown in FIGS. 4A to 5) that is the outermost layer on one side is not shown. FIG. 4A is a sectional view taken along a line IVa-IVa of FIG. 3, exemplifying the first liquid pipe 41. FIG. 4B is a sectional view taken along a line IVb-IVb of FIG. 3, exemplifying the second liquid pipe 42. FIG. 5 is a sectional view taken along a line V-V of FIG. 3, exemplifying the third liquid pipe 43. In FIGS. 3 to 5, a stacking direction of the metal layers 61 to 66 is denoted as the Z direction, any direction in a plane orthogonal to the Z direction is denoted as the X direction, and a direction in the plane orthogonal to the X direction is denoted as the Y direction (the same also applies to the other drawings). In the present disclosure, the description "as seen from above" means seeing in the Z direction.

As shown in FIGS. 3 and 4A, the first liquid pipe 41 has a first flow path 71. The first flow path 71 is a part of the flow path 51. The first liquid pipe 41 has pipe walls 101 and 102. The pipe walls 101 and 102 are parts of the pipe wall 90. The first flow path 71 is surrounded by an inner wall surface 101A of the pipe wall 101, an inner wall surface 102A of the pipe wall 102, a lower surface 61X of the metal layer 61, and an upper surface 66X of the metal layer 66. The first liquid pipe 41 includes, for example, first porous bodies 111 and 112 provided in the first flow path 71. The first porous body 111 is provided in contact with the inner wall surface 101A of the pipe wall 101, and the first porous body 112 is provided in contact with the inner wall surface 102A of the pipe wall 102. For example, the first porous body 111 is formed integrally with the pipe wall 101, and the first porous body 112 is formed integrally with the pipe wall 102. The first porous bodies 111 and 112 include, for example, a plurality of pores (not shown) formed in the metal layers 62 to 65.

A first space 81 in which the operating fluid C flows is formed between the first porous body 111 and the first porous body 112. The first space 81 is surrounded by surfaces of the first porous bodies 111 and 112 facing each other, the lower surface 61X of the metal layer 61, and the upper surface 66X of the metal layer 66.

As shown in FIGS. 3 and 4B, the second liquid pipe 42 has a second flow path 72. The second flow path 72 is a part of the flow path 52. The second liquid pipe 42 has pipe walls 201 and 202. The pipe walls 201 and 202 are parts of the pipe wall 90. The second flow path 72 is surrounded by an inner wall surface 201A of the pipe wall 201, an inner wall surface 202A of the pipe wall 202, the lower surface 61X of the metal layer 61, and the upper surface 66X of the metal layer 66. The second liquid pipe 42 includes, for example, second porous bodies 211 and 212 in the second flow path 72. The second porous body 211 is provided in contact with the inner wall surface 201A of the pipe wall 201, and the second porous body 212 is provided in contact with the inner wall surface 202A of the pipe wall 202. For example, the second porous body 211 is formed integrally with the pipe wall 201, and the second porous body 212 is formed integrally with the pipe wall 202. The second porous bodies 211 and 212 include, for example, a plurality of pores (not shown) formed in the metal layers 62 to 65.

A second space 82 in which the operating fluid C flows is formed between the second porous body 211 and the second porous body 212. The second space 82 is surrounded by surfaces of the second porous bodies 211 and 21 facing each other, the lower surface 61X of the metal layer 61, and the upper surface 66X of the metal layer 66.

For example, the pipe walls 101, 102, 201 and 202 extend in the Y direction in the vicinity of the third liquid pipe 43.

As shown in FIGS. 3 and 5, the third liquid pipe 43 has a third flow path 73 connecting to the first flow path 71 and the second flow path 72. The third flow path 73 is a part of the flow path 51, and is also a part of the flow path 52. The third liquid pipe 43 has pipe walls 301, 302 and 303. The pipe wall 301 is provided between the pipe walls 101 and 201, and continues to the pipe walls 101 and 201. The pipe wall 301 extends in the Y direction, similarly to the pipe walls 101 and 201. The pipe wall 302 continues to the pipe wall 102, and extends in the X direction toward the evaporator 10. The pipe wall 303 continues to the pipe wall 202, and extends in the X direction toward the evaporator 10. The pipe walls 301, 302 and 303 are parts of the pipe wall 90. The third flow path 73 is surrounded by an inner wall surface 301A of the pipe wall 301, an inner wall surface 302A of the pipe wall 302, an inner wall surface 303A of the pipe wall 303, the lower surface 61X of the metal layer 61, and the upper surface 66X of the metal layer 66.

The third liquid pipe 43 includes, for example, third porous bodies 311 and 312 in the third flow path 73. The third porous body 311 is provided between the first porous body 111 and the second porous body 211, and continues to the first porous body 111 and the second porous body 211. The third porous body 311 is provided in contact with the inner wall surface 301A of the pipe wall 301. The third porous body 312 is provided between the first porous body 112 and the second porous body 212, and continues to the first porous body 112 and the second porous body 212. The third porous body 312 fills an inside of the third liquid pipe 43 between the pipe wall 302 and the pipe wall 303, in one section (for example, a section shown in FIG. 5) perpendicular to the X direction, for example. That is, the third porous body 311 is provided in contact with the inner wall surface 302A of the pipe wall 302, the inner wall surface 303A of the pipe wall 303, the lower surface 61X of the metal layer 61, and the upper surface 66X of the metal layer 66. For example, the third porous body 311 is formed integrally with the pipe wall 301, and the third porous body 312 is formed integrally with the pipe walls 302 and 303. The third porous bodies 311 and 312 include, for example, a plurality of pores (not shown) formed in the metal layers 62 to 65.

A third space 83 in which the operating fluid C flows is formed between the third porous body 311 and the third porous body 312. The third space 83 is configured to communicate with the first space 81 and the second space 82. For example, the first space 81, the third space 83 and the second space 82 extend in the Y direction. The third space 83 is surrounded by surfaces of the third porous bodies 311 and 312 facing each other, the lower surface 61X of the metal layer 61, and the upper surface 66X of the metal layer 66.

In this way, the first liquid pipe 41 is provided with the first porous bodies 111 and 112, the second liquid pipe 42 is provided with the second porous bodies 211 and 212, the third liquid pipe 43 is provided with the third porous bodies 311 and 312, and the third porous body 312 is arranged in the vicinity of the evaporator 10. Thereby, the capillary force generated in the porous bodies guide the liquid operating fluid C in the liquid pipe 40 to the evaporator 10.

As a result, even when the vapor Cv intends to flow back in the liquid pipe 40 due to heat leak from the evaporator 10, for example, the vapor Cv can be pushed and returned by the capillary force acting from the porous bodies in the liquid pipe 40 to the liquid operating fluid C, so that the vapor Cv can be prevented from flowing back.

As shown in FIG. 3, the evaporator 10 has a fourth flow path 74. The fourth flow path 74 is a part of the flow path 51, and is also a part of the flow path 52. The evaporator has pipe walls 401 and 402. The pipe wall 401 continues to the pipe wall 302, and the pipe wall 402 continues to the pipe wall 303. The pipe walls 401 and 402 are parts of the pipe wall 90. The evaporator 10 is surrounded by an inner wall surface 401A of the pipe wall 401, an inner wall surface 402A of the pipe wall 402, the lower surface 61X of the metal layer 61, and the upper surface 66X of the metal layer 66. The evaporator 10 includes, for example, a fourth porous body 411 having a comb-teeth shape in plan view in the fourth flow path 74. The fourth porous body 411 may be provided in contact with the inner wall surface 401A of the pipe wall 401, the inner wall surface 402A of the pipe wall 402, the lower surface 61X of the metal layer 61, and the upper surface 66X of the metal layer 66. For example, the fourth porous body 411 is formed integrally with the pipe walls 401 and 402. The fourth porous body 411 includes, for example, a plurality of pores (not shown) formed in the metal layers 62 to 65.

In the evaporator 10, a region in which the fourth porous body 411 is not provided is formed with a space 84. The space 84 connects to the flow path 51 of the first vapor pipe 31 and the flow path 52 of the second vapor pipe 32. In the space 84, the vapor Cv of the operating fluid C flows.

The operating fluid C is guided from the liquid pipe 40-side to the evaporator 10, and permeates into the fourth porous body 411. The operating fluid C permeating into the fourth porous body 411 in the evaporator 10 is vaporized by heat generated in the heat generation component 120, so that the vapor Cv is generated. The vapor Cv flows into the first vapor pipe 31 and the second vapor pipe 32 through the space 84 in the evaporator 10. Note that, in FIG. 3, the number of protrusions (comb teeth) is set to four as an example. That is, the number of protrusions (comb teeth) can be set as appropriate. When a contact area between the protrusions and the space 84 increases, the operating fluid C is likely to evaporate and the pressure loss is likely to be reduced.

Note that, the liquid pipe 40 is formed with an injection port (not shown) for injecting the operating fluid C. The injection port is used to inject the operating fluid C, and is blocked after the operating fluid C is injected. Therefore, the loop-type heat pipe 1 is kept airtight.

In the first embodiment, since the first condenser 21 and the second condenser 22 are provided for one evaporator 10, a heat radiation area is increased, so that the heat applied to the evaporator 10 is likely to be radiated. In addition, since the third liquid pipe 43 includes the third flow path 73 connecting to the first flow path 71 and the second flow path 72, the operating fluid C flowing through the first flow path 71 and the operating fluid C flowing through the second flow path 72 join and are supplied to the evaporator 10 via the third flow path 73. Therefore, even when there is a difference of easiness of heat radiation between the first condenser 21 and the second condenser 22, the liquid operating fluid C can be continuously stably supplied to the evaporator 10. That is, according to the first embodiment, it is possible to efficiently radiate the heat while suppressing dryout.

In addition, as described above, the operating fluid C is injected from the injection port into the liquid pipe 40. In the first embodiment, since the first space 81 and the second space 82 communicate with each other with the third space 83 being interposed therebetween, the operating fluid C injected into the liquid pipe 40 can rapidly easily spread into the first liquid pipe 41 and the second liquid pipe 42.

Note that, the porous bodies may also be provided in parts of the first condenser 21 and the second condenser 22, or may also be provided in parts of the first vapor pipe 31 and the second vapor pipe 32.

Second Embodiment

Figure 6:
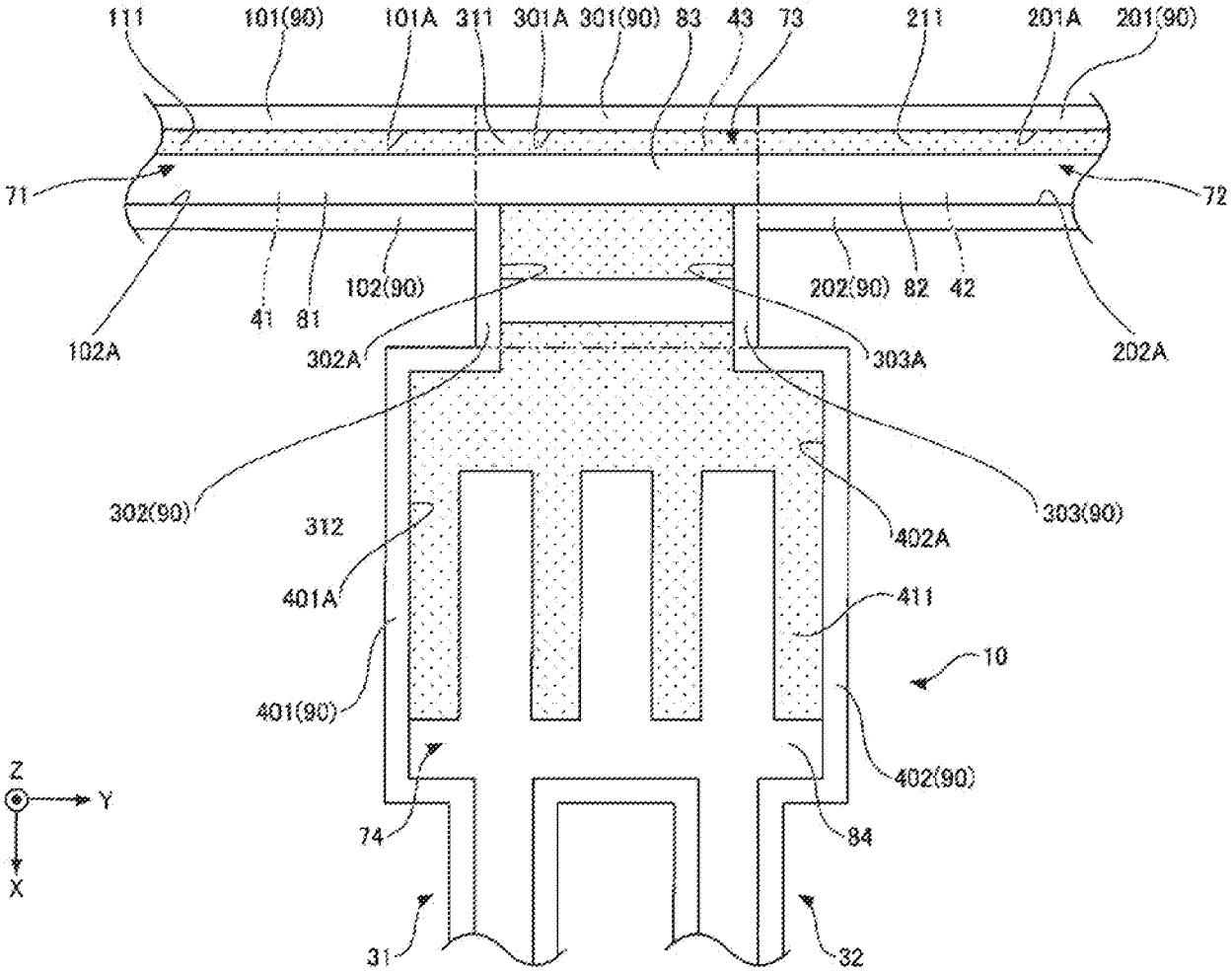
FIG. 6 is a schematic plan view depicting an evaporator and a liquid pipe of a loop-type heat pipe in accordance with a second embodiment.

In a second embodiment, the configuration of the liquid pipe 40 is different from the first embodiment. In the second embodiment, the descriptions of the same constitutional parts as the above-described embodiment may be omitted. FIG. 6 is a schematic plan view depicting the evaporator 10 and the liquid pipe 40 of a loop-type heat pipe in accordance with the second embodiment. In FIG. 6, the metal layer (the metal layer 61 shown in FIGS. 4A to 5) that is the outermost layer on one side is not shown.

As shown in FIG. 6, in the second embodiment, the first liquid pipe 41 includes the first porous body 111 but does not include the first porous body 112. The first space 81 is formed between the first porous body 111 and the pipe wall 102. The second liquid pipe 42 includes the second porous body 211 but does not include the second porous body 212. The second space 82 is formed between the second porous body 211 and the pipe wall 202. The third liquid pipe 43 includes the third porous bodies 311 and 312. However, the third porous body 312 is provided only between the pipe wall 302 and the pipe wall 303.

The other configurations are similar to the first embodiment.

Also in the second embodiment, the similar effects to the first embodiment can be achieved. In addition, as compared to the first embodiment, when the sectional areas of the first flow path 71 and the second flow path 72 are the same, volumes of the first space 81, the second space 82 and the third space 83 are large. Therefore, it is possible to store more operating fluid C in the vicinity of the evaporator 10.

Third Embodiment

Figure 7:
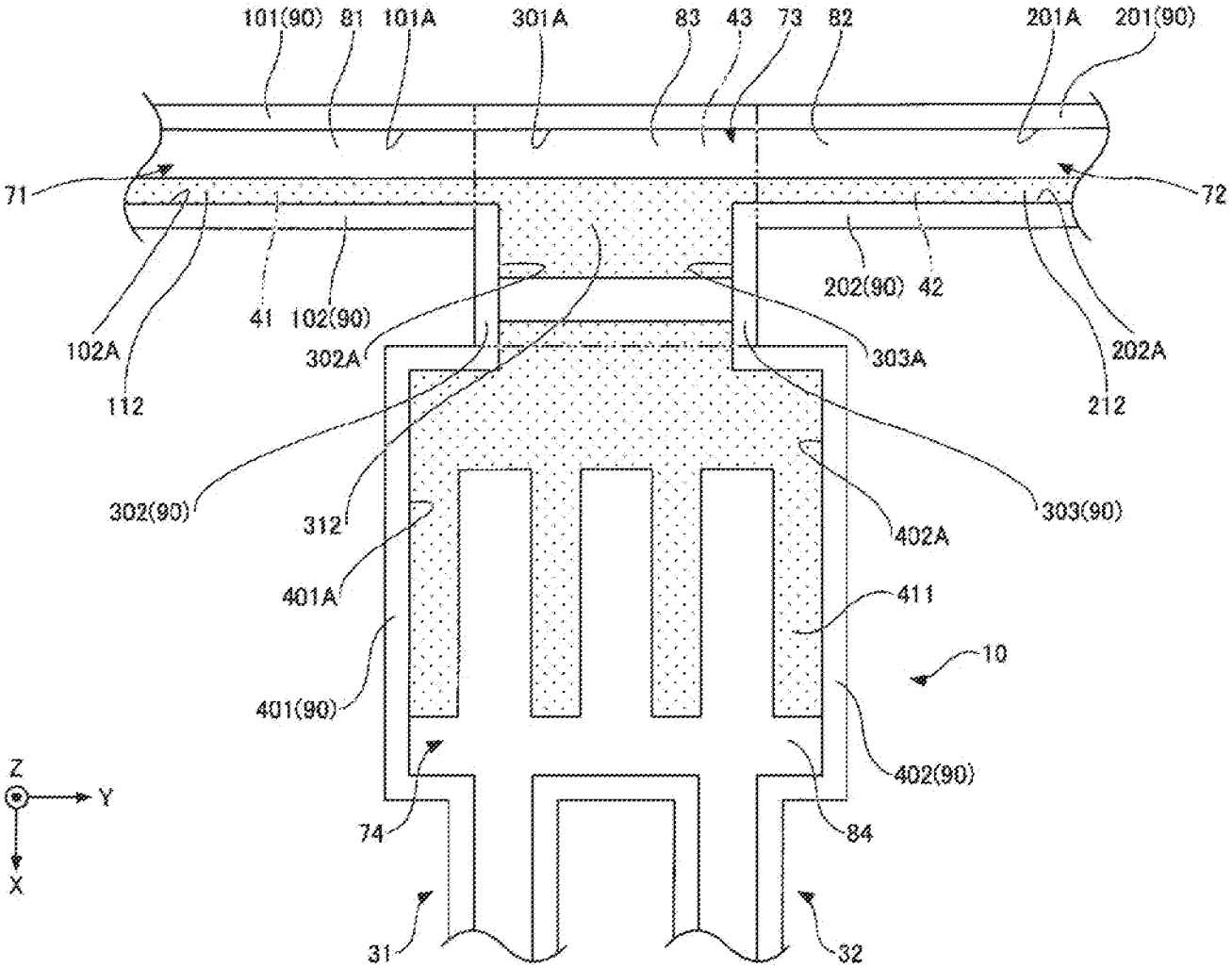
FIG. 7 is a schematic plan view depicting an evaporator and a liquid pipe of a loop-type heat pipe in accordance with a third embodiment.

In a third embodiment, the configuration of the liquid pipe 40 is different from the first embodiment. In the third embodiment, the descriptions of the same constitutional parts as the above-described embodiments may be omitted. FIG. 7 is a schematic plan view depicting the evaporator 10 and the liquid pipe 40 of a loop-type heat pipe in accordance with the third embodiment. In FIG. 7, the metal layer (the metal layer 61 shown in FIGS. 4A to 5) that is the outermost layer on one side is not shown.

As shown in FIG. 7, in the third embodiment, the first liquid pipe 41 includes the first porous body 112 but does not include the first porous body 111. The first space 81 is formed between the first porous body 112 and the pipe wall 101. The second liquid pipe 42 includes the second porous body 212 but does not include the second porous body 211. The second space 82 is formed between the second porous body 212 and the pipe wall 201. The third liquid pipe 43 includes the third porous body 312 but does not include the third porous body 311. The third space 83 is formed between the third porous body 312 and the pipe wall 301.

The other configurations are similar to the first embodiment.

Also in the third embodiment, the similar effects to the first embodiment can be achieved. In addition, as compared to the first embodiment, when the sectional areas of the first flow path 71 and the second flow path 72 are the same, volumes of the first space 81, the second space 82 and the third space 83 are large. Therefore, it is possible to store more operating fluid C in the vicinity of the evaporator 10.

Fourth Embodiment

Figure 8:
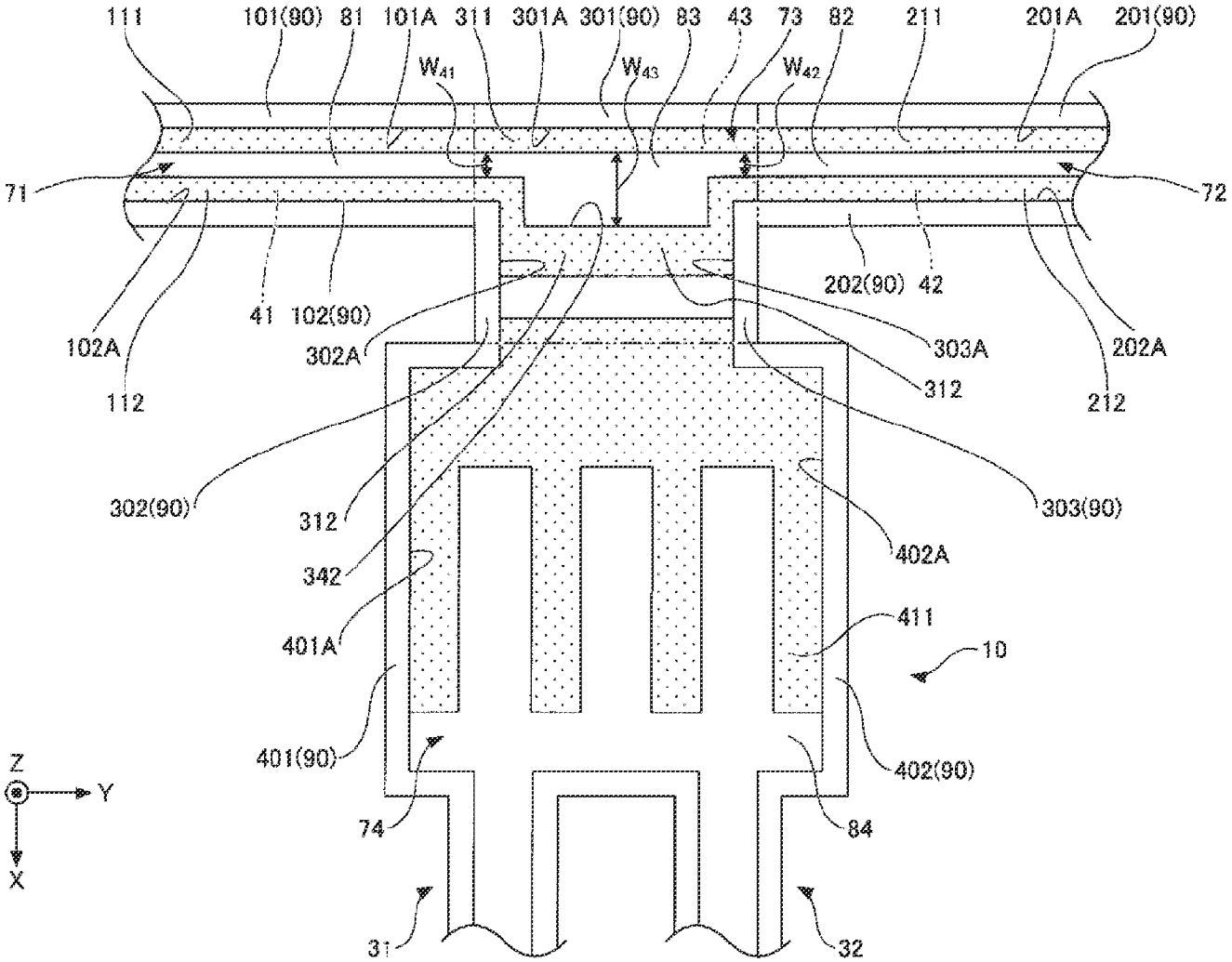
FIG. 8 is a schematic plan view depicting an evaporator and a liquid pipe of a loop-type heat pipe in accordance with a fourth embodiment.

In a fourth embodiment, the configuration of the liquid pipe 40 is different from the first embodiment. In the fourth embodiment, the descriptions of the same constitutional parts as the above-described embodiments may be omitted. FIG. 8 is a schematic plan view depicting the evaporator 10 and the liquid pipe 40 of a loop-type heat pipe in accordance with the fourth embodiment. In FIG. 8, the metal layer (the metal layer 61 shown in FIGS. 4A to 5) that is the outermost layer on one side is not shown.

As shown in FIG. 8, in the fourth embodiment, the third porous body 312 is formed with a concave portion 342 that is concave toward the evaporator 10, as seen from above. The concave portion 342 is formed on a further pipe wall 303-side than the inner wall surface 302A of the pipe wall 302 and on a further pipe wall 302-side than the inner wall surface 303A of the pipe wall 303, in the Y direction. As seen from above, a third width $W_{43}$ of the third space 83 in a portion at which the concave portion 342 is formed is greater than a first width $W_{41}$ of the third space 83 at a boundary with the first space 81 and a second width $W_{42}$ of the third space 83 at a boundary with the second space 82. That is, as seen from above, the third space 83 has the first width $W_{41}$ at the boundary with the first space 81, the second width $W_{42}$ at the boundary with the second space 82, and the third width $W_{43}$ greater than the first width $W_{41}$ and the second width $W_{42}$ between the boundary with the first space 81 and the boundary with the second space 82.

The other configurations are similar to the first embodiment.

Also in the fourth embodiment, the similar effects to the first embodiment can be achieved. In addition, as compared to the first embodiment, when the sectional areas of the first flow path 71 and the second flow path 72 are the same, volume of the third space 83 is large. Therefore, it is possible to store more operating fluid C in the vicinity of the evaporator 10.

Fifth Embodiment

Figure 9:
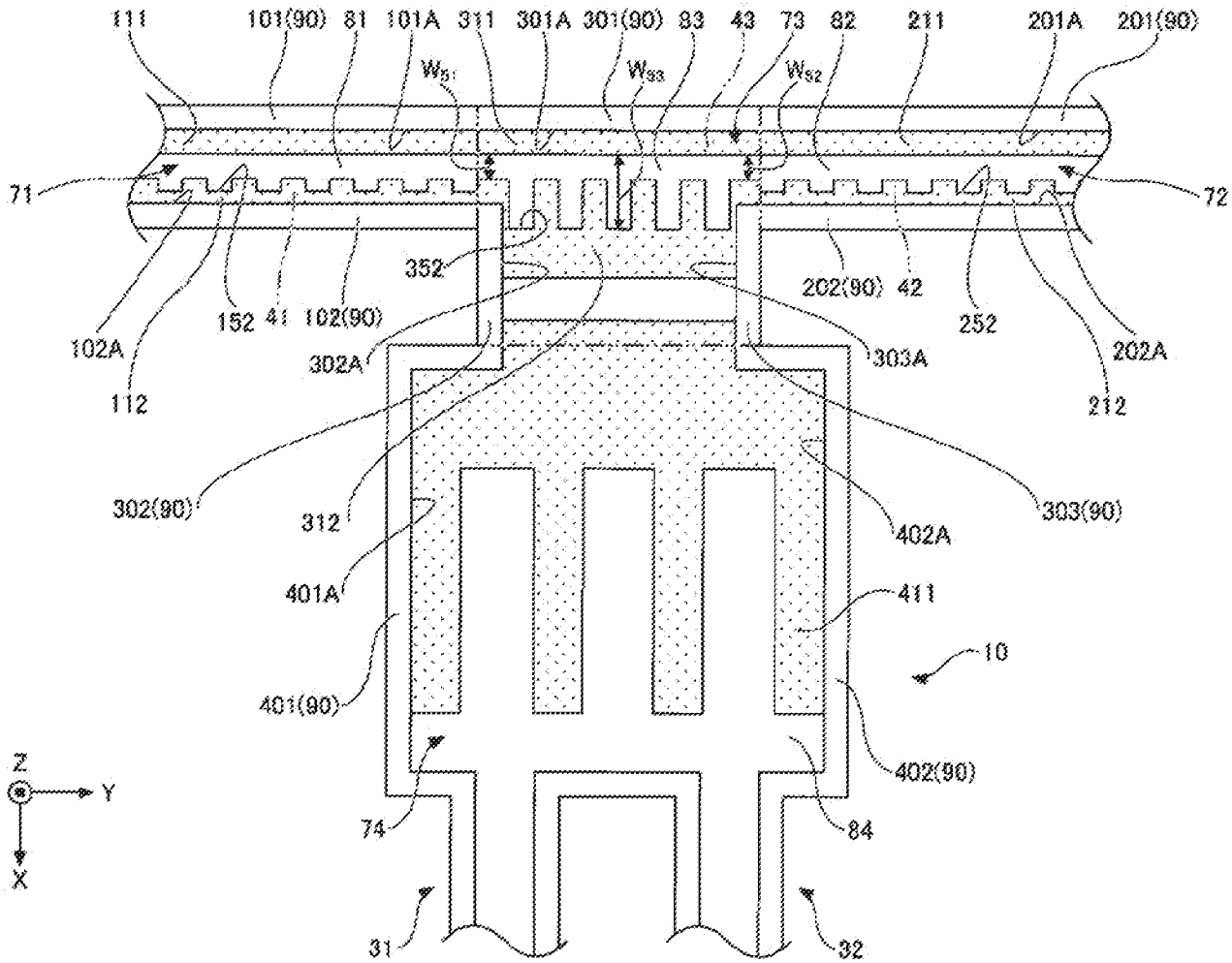
FIG. 9 is a schematic plan view depicting an evaporator and a liquid pipe of a loop-type heat pipe in accordance with a fifth embodiment.

In a fifth embodiment, the configuration of the liquid pipe 40 is different from the first embodiment. In the fifth embodiment, the descriptions of the same constitutional parts as the above-described embodiments may be omitted. FIG. 9 is a schematic plan view depicting the evaporator 10 and the liquid pipe 40 of a loop-type heat pipe in accordance with the fifth embodiment. In FIG. 9, the metal layer (the metal layer 61 shown in FIGS. 4A to 5) that is the outermost layer on one side is not shown.

As shown in FIG. 9, in the fifth embodiment, the third porous body 312 is formed with a plurality of concave portions 352 that is concave toward the evaporator 10, as seen from above. The plurality of concave portions 352 is formed on a further pipe wall 303-side than the inner wall surface 302A of the pipe wall 302 and on a further pipe wall 302-side than the inner wall surface 303A of the pipe wall 303, in the Y direction. As seen from above, a third width $W_{53}$ of the third space 83 in a portion at which the concave portion 352 is formed is greater than a first width $W_{51}$ of the third space 83 at a boundary with the first space 81 and a second width $W_{52}$ of the third space 83 at a boundary with the second space 82. That is, as seen from above, the third space 83 has the first width $W_{51}$ at the boundary with the first space 81, the second width $W_{52}$ at the boundary with the second space 82, and the third width $W_{53}$ greater than the first width $W_{51}$ and the second width $W_{52}$ between the boundary with the first space 81 and the boundary with the second space 82.

In addition, the first porous body 112 is formed with a plurality of concave portions 152 that is concave toward the pipe wall 102, as seen from above. The plurality of concave portions 152 is formed side by side along the pipe wall 102. The second porous body 212 is also formed with a plurality of concave portions 252 that is concave toward the pipe wall 202, as seen from above. The plurality of concave portions 252 is formed side by side along the pipe wall 202.

Also in the fifth embodiment, the similar effects to the first embodiment can be achieved. In addition, as compared to the first embodiment, when the sectional areas of the first flow path 71 and the second flow path 72 are the same, volumes of the first space 81, the second space 82 and the third space 83 are large. Therefore, it is possible to store more operating fluid C in the vicinity of the evaporator 10.

Note that, the number of the condensers is not limited to two. For example, three or more condensers may be connected to the evaporator via the vapor pipe and the liquid pipe.

Note that the concave portion 342 in the third porous body 312 of the fourth embodiment and each of the plurality of concave portions 352 and each of the plurality of concave portions 252 in the fifth embodiment are different from the bottomed hole of the pores of the porous body and the size of the concave portions are larger than the bottomed hole of the pores of the porous body.

Although the preferred embodiments have been described in detail, the present disclosure is not limited to the above-described embodiments and the embodiments can be diversely modified and replaced without departing from the scope defined in the claims.

What is claimed is:

1. A loop-type heat pipe comprising:

an evaporator configured to vaporize an operating fluid;

a first condenser and a second condenser configured to condense the operating fluid;

a liquid pipe configured to connect the evaporator and the first condenser and second condenser;

a first vapor pipe configured to connect the evaporator and the first condenser; and a second vapor pipe configured to connect the evaporator and the second condenser, wherein the liquid pipe comprises:

a first liquid pipe having a first flow path and connected to the first condenser, the first liquid pipe including a first porous body defining a first space within the first liquid pipe at which the first porous body is not provided, a second liquid pipe having a second flow path and connected to the second condenser, the second liquid pipe including a second porous body defining a second space within the second liquid pipe at which the second porous body is not provided, and a third liquid pipe having a third flow path connecting to the first flow path and the second flow path and connected to the evaporator, the third liquid pipe including a pair of third porous bodies defining a third space within the third liquid pipe at which the pair of third porous bodies is not provided, the third space configured to communicate with the first space and the second space, the evaporator, the first vapor pipe, the first condenser, the first liquid pipe, and the third liquid pipe form a first loop-shaped flow path, the evaporator, the second vapor pipe, the second condenser, the second liquid pipe, and the third liquid pipe form a second loop-shaped flow path, the first vapor pipe, the first condenser, and the first liquid pipe of the first loop-shaped flow path are formed independently from the second vapor pipe, the second condenser, and the second liquid pipe of the second loop-shaped flow path, so that the first loop-shaped flow path and the second loop-shaped flow path are formed independently from each other except at the third liquid pipe and the evaporator, and the first loop-shaped flow path and the second loop-shaped flow path share only the third liquid pipe and the evaporator, the third space is defined between a first of the pair of third porous bodies and a second of the pair of third porous bodies, the second of the pair of third porous bodies extends between and contacts each of a pair of opposed walls of the third liquid pipe so as to fill an inside of the third liquid pipe at the pair of opposed walls of the third liquid pipe, the pair of opposed walls projecting away from a wall of the third liquid pipe on which the first of the pair of third porous bodies is provided, and as seen from above, the second of the pair of third porous bodies includes a concave portion that is concave toward the evaporator and away from the first of the pair of third porous bodies and the wall of the third liquid pipe on which the first of the pair of third porous bodies is provided, the concave portion being provided between a boundary of the third space with the first space and a boundary of the third space with the second space, so that the third space has a first width at the boundary with the first space, a second width at the boundary with the second space, and a third width greater than the first width and the second width at the concave portion between the boundary with the first space and the boundary with the second space.

2. The loop-type heat pipe according to claim 1, wherein both the operating fluid flowing through the first flow path and the operating fluid flowing through the second flow path flow into the evaporator via the third flow path.

3. The loop-type heat pipe according to claim 1, wherein each of the evaporator, the first condenser, the second condenser, the liquid pipe, the first vapor pipe and the second vapor pipe is constituted by a plurality of stacked metal layers.

4. The loop-type heat pipe according to claim 1, wherein the first vapor pipe is configured to directly connect the evaporator and the first condenser, and the second vapor pipe is configured to directly connect the evaporator and the second condenser.

5. The loop-type heat pipe according to claim 1, wherein the first porous body is provided on an inner surface of walls defining the first liquid pipe and the first space is defined centrally in the first liquid pipe;

the second porous body is provided on an inner surface of walls defining the second liquid pipe and the second space is defined centrally in the second liquid pipe; and the pair of third porous bodies is provided on an inner surface of walls defining the third liquid pipe and the third space is defined centrally in the third liquid pipe.

6. The loop-type heat pipe according to claim 1, wherein the third width is between an inner surface of the first of the pair of third porous bodies and an inner surface of the second of the pair of third porous bodies at the concave portion, as seen from above.

7. The loop-type heat pipe according to claim 1, wherein the first porous body is a pair of first porous bodies respectively provided on opposed walls of the first liquid pipe, a first of the pair of first porous bodies provided on one of the opposed walls of the first liquid pipe and being continuous with the first of the pair of third porous bodies, and a second of the pair of first porous bodies provided on another of the opposed walls of the first liquid pipe and being continuous with the second of the pair of third porous bodies, the second porous body is a pair of second porous bodies respectively provided on opposed walls of the second liquid pipe, a first of the pair of second porous bodies provided on one of the opposed walls of the second liquid pipe and being continuous with the first of the pair of third porous bodies, and a second of the pair of second porous bodies provided on another of the opposed walls of the second liquid pipe and being continuous with the second of the pair of third porous bodies, the first of the pair of third porous bodies being disposed between the first of the pair of first porous bodies and the first of the pair of second porous bodies, the first of the pair of first porous bodies, the first of the pair of second porous bodies, and the first of the pair of third porous bodies having a uniform width, the second of the pair of first porous bodies and the second of the pair of second porous bodies having a uniform width, the first width being equal to a width between an inner surface of the first of the pair of first porous bodies and an inner surface of the second of the pair of first porous bodies as seen from above, the second width being equal to a width between an inner surface of the first of the pair of second porous bodies and an inner surface of the second of the pair of second porous bodies as seen from above, and the third width being between an inner surface of the first of the pair of third porous bodies and an inner surface of the second of the pair of third porous bodies at the concave portion as seen from above.

* * * * *